US009416474B2

(12) United States Patent
Catallo

(10) Patent No.: US 9,416,474 B2
(45) Date of Patent: Aug. 16, 2016

(54) WASHER FOR TUBULAR KNITTED FABRIC MATERIAL

(71) Applicant: Frank Catallo, Old Westbury, NY (US)

(72) Inventor: Frank Catallo, Old Westbury, NY (US)

(73) Assignee: Teresa Catallo, Old Westbury, NY (US)

( * ) Notice: Subject to any disclaimer, the term of this patent is extended or adjusted under 35 U.S.C. 154(b) by 596 days.

(21) Appl. No.: 13/861,550

(22) Filed: Apr. 12, 2013

(65) Prior Publication Data

US 2014/0304923 A1 Oct. 16, 2014

(51) Int. Cl.

| | |
|---|---|
| ***D06B 1/14*** | (2006.01) |
| ***D06B 3/10*** | (2006.01) |
| ***D06B 3/20*** | (2006.01) |

(52) U.S. Cl.

CPC ..... *D06B 1/147* (2013.01); *D06B 3/105* (2013.01); *D06B 3/201* (2013.01)

(58) Field of Classification Search

CPC ..... D06B 1/14; D06B 1/145; D06B 1/147; D06B 3/045; D06B 3/105; D06B 3/185; D06B 3/20; D06B 3/201; D06B 3/345

See application file for complete search history.

(56) References Cited

U.S. PATENT DOCUMENTS

| | | | | | |
|---|---|---|---|---|---|
| 2,597,528 | A | | 5/1952 | Redman | |
| 3,207,616 | A | | 9/1965 | Cohn | |
| 4,182,140 | A | | 1/1980 | Sando | |
| 4,266,983 | A | * | 5/1981 | Laszlo | D06B 15/04 134/21 |
| 4,285,694 | A | | 8/1981 | Itoh | |
| 4,318,209 | A | * | 3/1982 | Schuierer | D06B 3/26 26/74 |
| 4,799,367 | A | * | 1/1989 | Schuierer | D06B 3/105 26/85 |
| 4,843,669 | A | | 7/1989 | Koch | |
| 5,046,208 | A | | 9/1991 | Catallo | |
| 5,826,289 | A | * | 10/1998 | Catallo | D06B 3/105 68/13 R |

* cited by examiner

*Primary Examiner* — Joseph L Perrin
(74) *Attorney, Agent, or Firm* — Charles E. Baxley

(57) ABSTRACT

A washer that washes a continuous piece of tubular knitted fabric material. The washer includes a frame, a set of rollers, an air nozzle rack, and a controller. The frame rests on a support surface. The set of rollers are rotatably attached within the frame and guide the material through a washing liquid to wash the material. The air nozzle rack is replaceably attached to within the frame and blows air onto the material to cause ballooning of the material to maximize exposure of a total surface area of the material to the washing liquid. The controller is operatively connected to the set of rollers and minimizes and keeps constant the tension of the material as the material passes through the washing liquid under an influence of the air nozzle rack to thereby provide a more effective wash of the material.

42 Claims, 12 Drawing Sheets

WASHER FOR TUBULAR KNITTED FABRIC MATERIAL

1. BACKGROUND OF THE INVENTION

A. Field of the Invention

The embodiments of the present invention relate to a fabric washer, and more particularly, the embodiments of the present invention relate to a washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material.

B. Description of the Prior Art

A continuous piece of tubular knitted fabric material needs to be cleaned in a continuous manner before and after dyeing, scouring, bleaching, and resin finishing, etc. Thus, there exists a need for a washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material.

Numerous innovations for fabric processing devices have been provided in the prior art, which will be described below in chronological order to show advancement in the art, and which are incorporated herein by reference thereto. Even though these innovations may be suitable for the specific individual purposes to which they address, nevertheless, they differ from the embodiments of the present invention in that they do not teach a washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material.

(1) U.S. Pat. No. 2,597,528 to Redman.

U.S. Pat. No. 2,597,528—issued to Redman on May 20, 1952 in U.S. class 26 and subclass 55—teaches an apparatus for reducing shrinkage in tubular knitted fabric that has been elongated lengthwise and narrowed widthwise by processing subsequent to knitting of the fabric. The apparatus includes apparatus for moving the tubular knitted fabric lengthwise through a treatment zone while affording lengthwise freedom of the fabric, apparatus within the zone for internally expanding the tubular fabric widthwise to effect lengthwise shortening or condensing of the fabric, and fabric-handling apparatus permitting the fabric to relax so as to effect repositioning of the fabric stitches subsequently to their original knitted form and restoration of the fabric substantially to its normal condition.

(2) U.S. Pat. No. 3,207,616 to Cohn et al.

U.S. Pat. No. 3,207,616—issued to Cohn et al. On Sep. 21, 1965 in U.S. class 117 and subclass 7—teaches an apparatus for treating tubular knitted fabric. The apparatus includes apparatus for laterally distending the tubular fabric to a flat form and a predetermined uniform width, a first resilient treating roller positioned intermediately adjacent the discharge end of the distending apparatus for establishing full-fabric-width dimension control contact between the fabric and the first treating roller substantially immediately as the spread fabric leaves the spreading apparatus, and a second resilient treating roller positioned generally below and forward of the first treating roller and forming therewith a resilient extracting nip through which the fabric is directed. The second treating roller has an upper surface portion positioned for full-fabric-width dimension control contact with the fabric. A third resilient treating roller is positioned generally above and forward of the second treating roller, and forms therewith, a resilient padding nip. Apparatus drives the treating rollers in a manner to achieve substantially equal peripheral speeds. Sealing plates engage end portions of the treating rollers so as to form a reservoir for maintaining a continuous bath of treating solution extending from the extracting nip to the packing nip. One side of each of the nips are exposed directly to the treating solution bath. The upper surface portion of the second treating roller forms the bottom of the reservoir.

(3) U.S. Pat. No. 4,182,140 to Sando et al.

U.S. Pat. No. 4,182,140—issued to Sando et al. on Jan. 8, 1980 in U.S. class 68 and subclass 5 E—teaches an apparatus for cleaning cloth with steam and liquid flow. A cloth, such as a textile, knitted fabrics, or a tubular knitted material, is supplied into a chamber containing wet heat of about 105° to 110° C., then it is made to advance in a left and right zigzag manner. The cloth is contacted with a cleaning liquid flowing down from the upper part of the chamber.

(4) U.S. Pat. No. 4,285,694 to Itoh et al.

U.S. Pat. No. 4,285,694—issued to Itoh et al. on Aug. 25, 1981 in U.S. class 8 and subclass 532—teaches a cold-padding and batch-dyeing process for a tubular knitted fabric. The process includes the steps of feeding the fabric into a padding tank, subjecting the fabric to air inflating, blowing compressed air into the fabric to expand the fabric into the fabric's original tubular shape, squeezing the fabric at a squeezing rate of 95 to 120% by passing the fabric between a pair of mangles each having a layer of rubber having a Shore hardness of 55 to 70, and leaving the fabric for ageing over a period of at least four hours. The length of time between entry of the fabric into the padding tank and the fabric's departure from the mangles is controlled to 10 to 20 seconds.

(5) U.S. Pat. No. 4,843,669 to Koch et al.

U.S. Pat. No. 4,843,669—issued to Koch et al. on Jul. 4, 1989 in U.S. class 8 and subclass 151—teaches wet processing, in particular, of knitted tubular material in the broad tubular state, which in a first processing section is led through a fluid bath then inflated to form a balloon section and afterwards led in the broad tubular state through the gap between a pair of squeezer rollers. Within the fluid bath, the incoming material in hank form is subjected to twist sensing, and if any twist is detected, the incoming tubular material is rotated in the region before the first processing section to undo the twist. The completely and stably relaxed and untwisted tubular material leaves this first processing section in a stable broad tubular state and can then be passed in an optimum manner through the succeeding principal processing sections.

(6) U.S. Pat. No. 5,046,208 to Catallo.

U.S. Pat. No. 5,046,208—issued to Catallo on Sep. 10, 1991 in U.S. class 8 and subclass 151—teaches an extractor wherein tubular knitted fabric is ballooned, prior to the extraction of, usually water from the fabric, in an arrangement that includes a nip formed by two rolls. A tubular knit fabric additive-applying mechanism is formed by providing a reservoir having these two rolls and sealing or dam members disposed at each of the opposite ends of the above-mentioned rolls. A single drive is provided one roll and functions to drive the second roll and a third roll disposed to form a nip with the second roll to extract excess additive from the fabric as it passes through the last-mentioned nip. A method of applying an additive to a tubular knitted fabric moving the fabric through a nip to extract liquid therefrom and then immediately subjecting the fabric to an application of additive and immediately following this application by subjecting the fabric to the removal of the additive in a second nip.

It is apparent that numerous innovations for fabric processing devices have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material.

2. SUMMARY OF THE INVENTION

Thus, an object of the embodiments of the present invention is to provide a washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material, which avoids the disadvantages of the prior art.

Briefly stated, another object of the embodiments of the present invention is to provide a washer utilizing a washing liquid to wash a continuous piece of tubular knitted fabric material having a total surface area and a tension and maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material. The washer includes a frame, a set of rollers, an air nozzle rack, and a controller. The frame rests on a support surface. The set of rollers are rotatably attached within the frame and guide the continuous piece of tubular knitted fabric material through the washing liquid to wash the continuous piece of tubular knitted fabric material. The air nozzle rack is replaceably attached to within the frame and blows air onto the continuous piece of tubular knitted fabric material to cause the ballooning of the continuous piece of tubular knitted fabric material to maximize the exposure of the total surface area of the continuous piece of tubular knitted fabric material to the washing liquid. The controller is operatively connected to the set of rollers and minimizes and keeps constant the tension of the continuous piece of tubular knitted fabric material as the continuous piece of tubular knitted fabric material passes through the washing liquid under an influence of the air nozzle rack to thereby provide the more effective wash of the continuous piece of tubular knitted fabric material.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

3. BRIEF DESCRIPTION OF THE FIGURES OF THE DRAWING

The figures of the drawing are briefly described as follows:

FIG. 1 is a diagrammatic side elevational view in partial section of the washer of the embodiments of the present invention utilizing a washing liquid and washing a continuous piece of tubular knitted fabric material having a total surface area and a tension and maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material;

Figure 15:
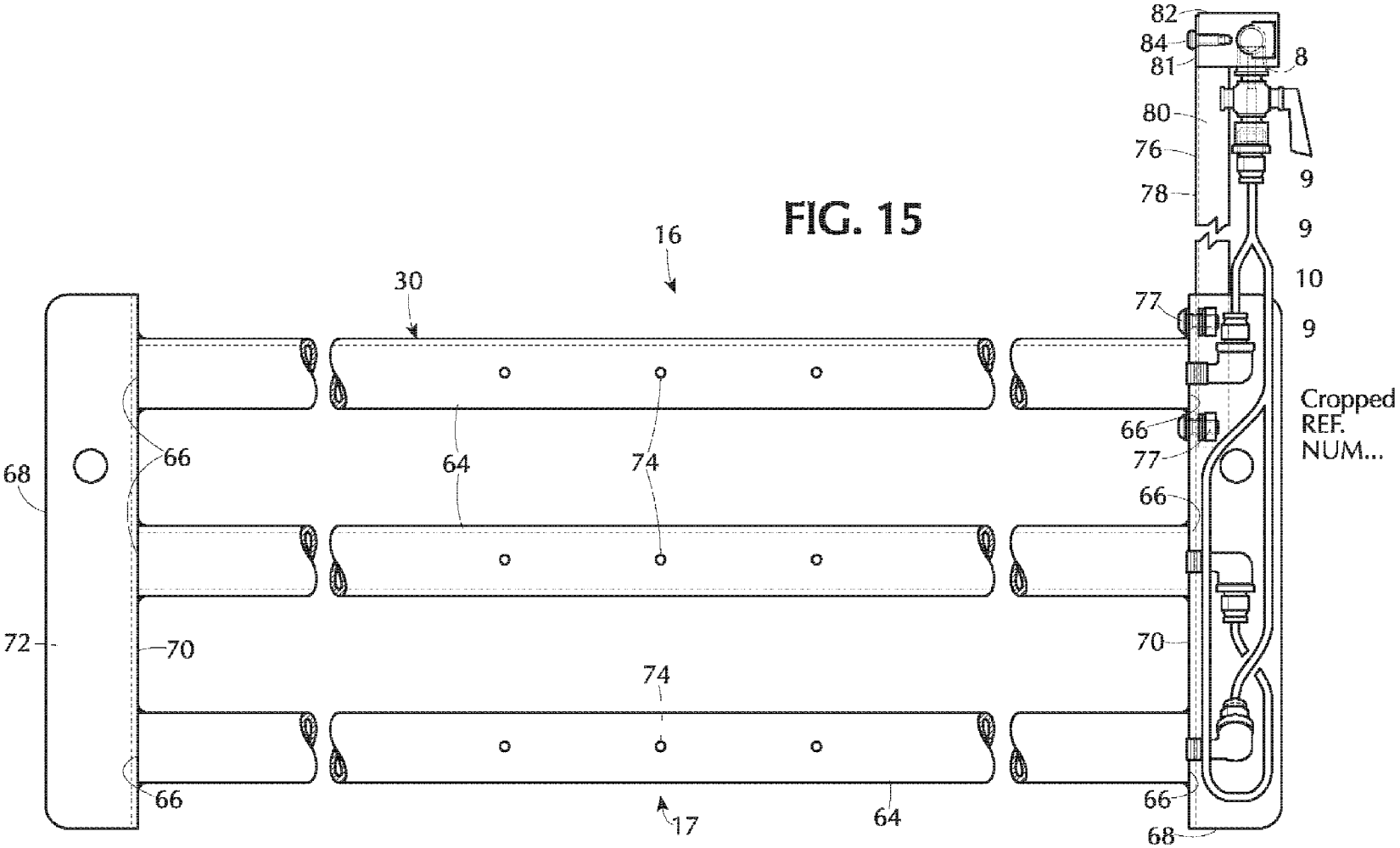
FIG. 15 is an enlarged diagrammatic front elevational view of the air nozzle rack of the washer of the embodiments of the present invention identified by ARROW 15 in FIG. 5.
Figure 16:
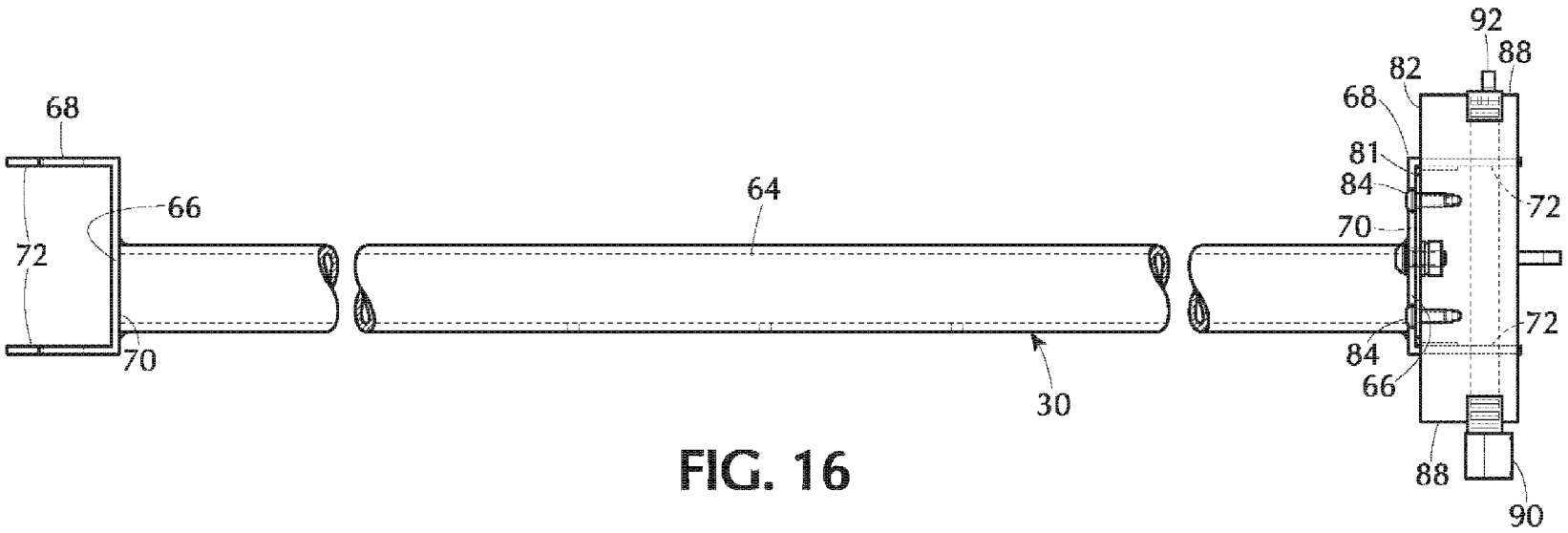
FIG. 16 is a diagrammatic top plan view taken generally in the direction of ARROW 16 in FIG. 15 of the air nozzle rack of the washer of the embodiments of the present invention.
Figure 17:
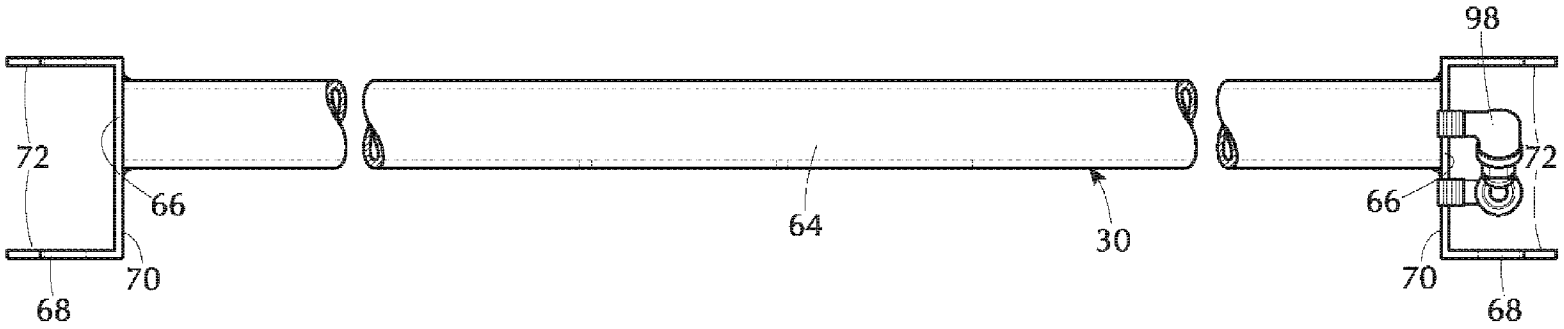
Figure 18:
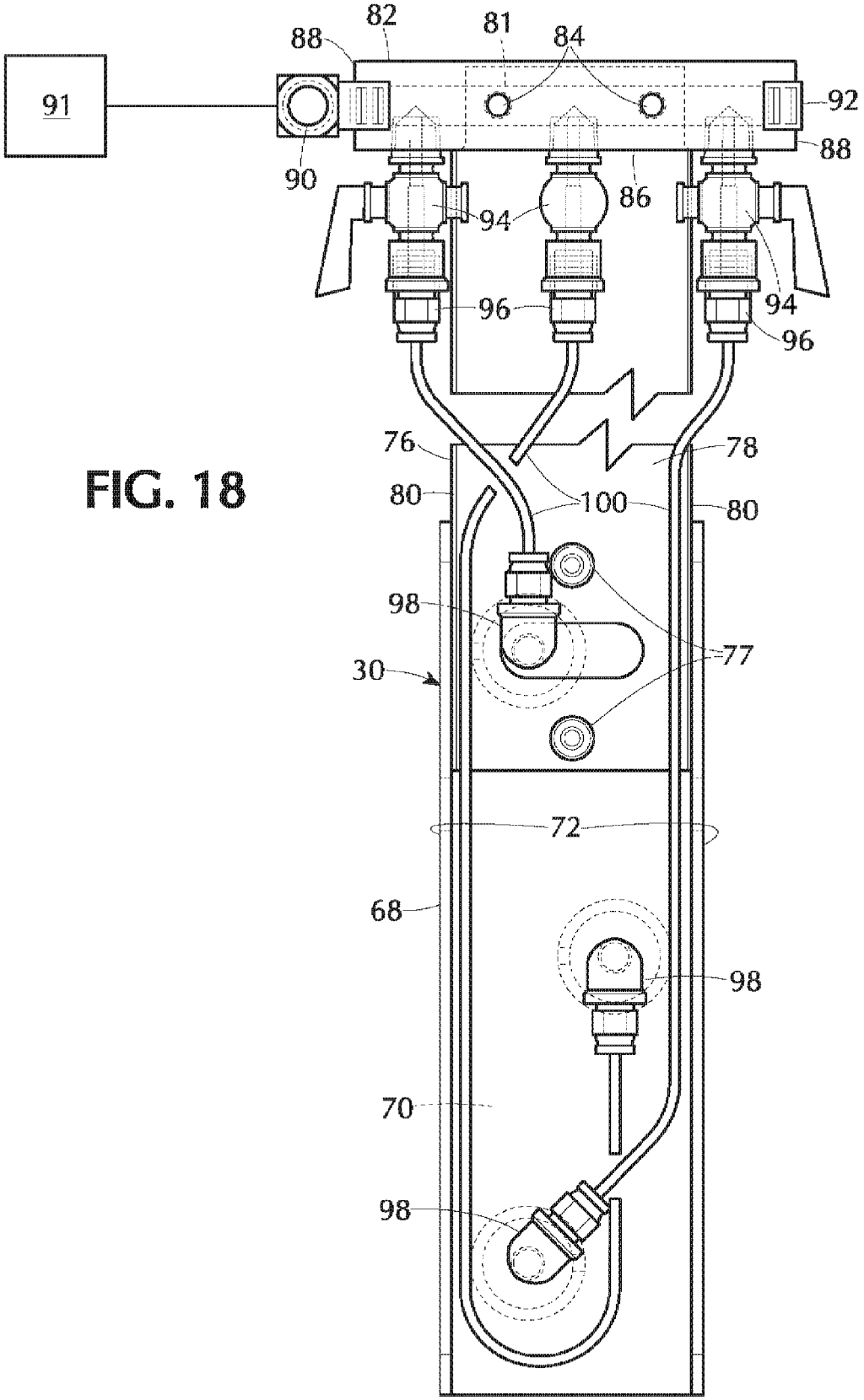

FIG. 17 is a diagrammatic bottom plan view taken generally in the direction of ARROW 17 in FIG. 15 of the air nozzle rack of the washer of the embodiments of the present invention; and FIG. 18 is an enlarged diagrammatic front elevational view taken generally in the direction of ARROW 18 in FIG. 15 of the air box manifold of the air nozzle rack of the washer of the embodiments of the present invention.

4. LIST OF REFERENCE NUMERALS UTILIZED IN THE FIGURES OF THE DRAWING

A. Introductory.

20 washer of embodiments of present invention for utilizing washing liquid 22 for washing continuous piece of tubular knitted fabric material 24 having total surface area and tension and for maximizing exposure of total surface area of continuous piece of tubular knitted fabric material 24 to washing liquid 22 by ballooning continuous piece of tubular knitted fabric material 24 while minimizing and keeping constant tension of continuous piece of tubular knitted fabric material 24 to thereby provide more effective wash of continuous piece of tubular knitted fabric material 24

22 washing liquid

24 continuous piece of tubular knitted fabric material

B. Overall Configuration of Washer 20.

26 frame for resting on support surface 34

28 set of rollers for guiding continuous piece of tubular knitted fabric material 24 through washing liquid 22 for washing continuous piece of tubular knitted fabric material 24

30 air nozzle rack for spraying air onto continuous piece of tubular knitted fabric material 24 to cause ballooning of continuous piece of tubular knitted fabric material 24 for maximizing exposure of total surface area of continuous piece of tubular knitted fabric material 24 to washing liquid 22

32 controller for minimizing and keeping constant tension of continuous piece of tubular knitted fabric material 24 as continuous piece of tubular knitted fabric material 24 passes through washing liquid 22 under influence of air nozzle rack 30 to thereby provide more effective wash of continuous piece of tubular knitted fabric material 24

34 support surface

C. Specific Configuration of Set of Rollers 28.

36 lower set of rollers of set of rollers 28

38 lower axle of each lower roller of lower set of rollers 36 of set of rollers 28

40 lower sprocket of each lower roller of lower set of rollers 36 of set of rollers 28

42 lower sprocket chain of lower set of rollers 36 of set of rollers 28

44 lower motor of lower set of rollers 36 of set of rollers 28

46 lower reducer of lower set of rollers 36 of set of rollers 28

48 lower motor sprocket of lower set of rollers 36 of set of rollers 28

50 upper set of rollers of set of rollers 28

52 upper axle of each upper roller of upper set of rollers 50 of set of rollers 28

54 upper sprocket of each upper roller of upper set of rollers 50 of set of rollers 28

56 upper sprocket chain of upper set of rollers 50 of set of rollers 28

58 upper motor of upper set of rollers 50 of set of rollers 28

60 upper reducer of upper set of rollers 50 of set of rollers 28

62 upper motor sprocket of upper set of rollers 50 of set of rollers 28

D. Specific Configuration of Air Nozzle Rack 30.

64 hollow tubes of air nozzle rack 30

66 pair of ends of each hollow tube of hollow tubes 64 of air nozzle rack 30

68 pair of brackets of air nozzle rack 30

70 web of each bracket of pair of brackets 68 of air nozzle rack 30

72 pair of flanges of each bracket of pair of brackets 68 of air nozzle rack 30

74 orifices of hollow tubes 64 of air nozzle rack 30 for spraying air onto continuous piece of tubular knitted fabric material 24 to cause ballooning of continuous piece of tubular knitted fabric material 24 for maximizing exposure of total surface area of continuous piece of tubular knitted fabric material 24 to washing liquid 22

76 manifold bracket of air nozzle rack 30

77 screws, washers, lock washers, and nuts of air nozzle rack 30

78 web of manifold bracket 76 of air nozzle rack 30

80 pair of flanges of manifold bracket 76 of air nozzle rack 30

81 uppermost end of manifold bracket 76 of air nozzle rack 30

82 air box manifold of air nozzle rack 30

84 pair of screws and lock washers of air box manifold 82 of air nozzle rack 30

86 lowermost surface of air box manifold 82 of air nozzle rack 30

88 pair of ends of air box manifold 82 of air nozzle rack 30

90 air fitting street elbow of one end of pair of ends 88 of air box manifold 82 of air nozzle rack 30 for communicating with air source 91

91 air source of air nozzle rack 30

92 brass pipe plug of other end of pair of ends 88 of air box manifold 82 of air nozzle rack 30

94 brass petcock valves of lowermost surface 86 of air box manifold 82 of air nozzle rack 30

96 straight male air fittings of air nozzle rack 30

98 straight, street elbow, and male air fittings of air nozzle rack 30

100 air hoses of air nozzle rack 30

E. Specific Configuration of Controller 32.

102 cabinet of controller 32

104 door of cabinet 102 of controller 32

106 handle of cabinet 102 of controller 32

108 control panel of cabinet 102 of controller 32

110 stop push button of control panel 108 of cabinet 102 of controller 32

112 start push button of control panel 108 of cabinet 102 of controller 32

114 upper roller speed rotary control of control panel 108 of cabinet 102 of controller 32

116 lower roller speed rotary control of control panel 108 of cabinet 102 of controller 32

5. DETAILED DESCRIPTION OF THE PREFERRED EMBODIMENTS

A. Introductory.

Figure 1:
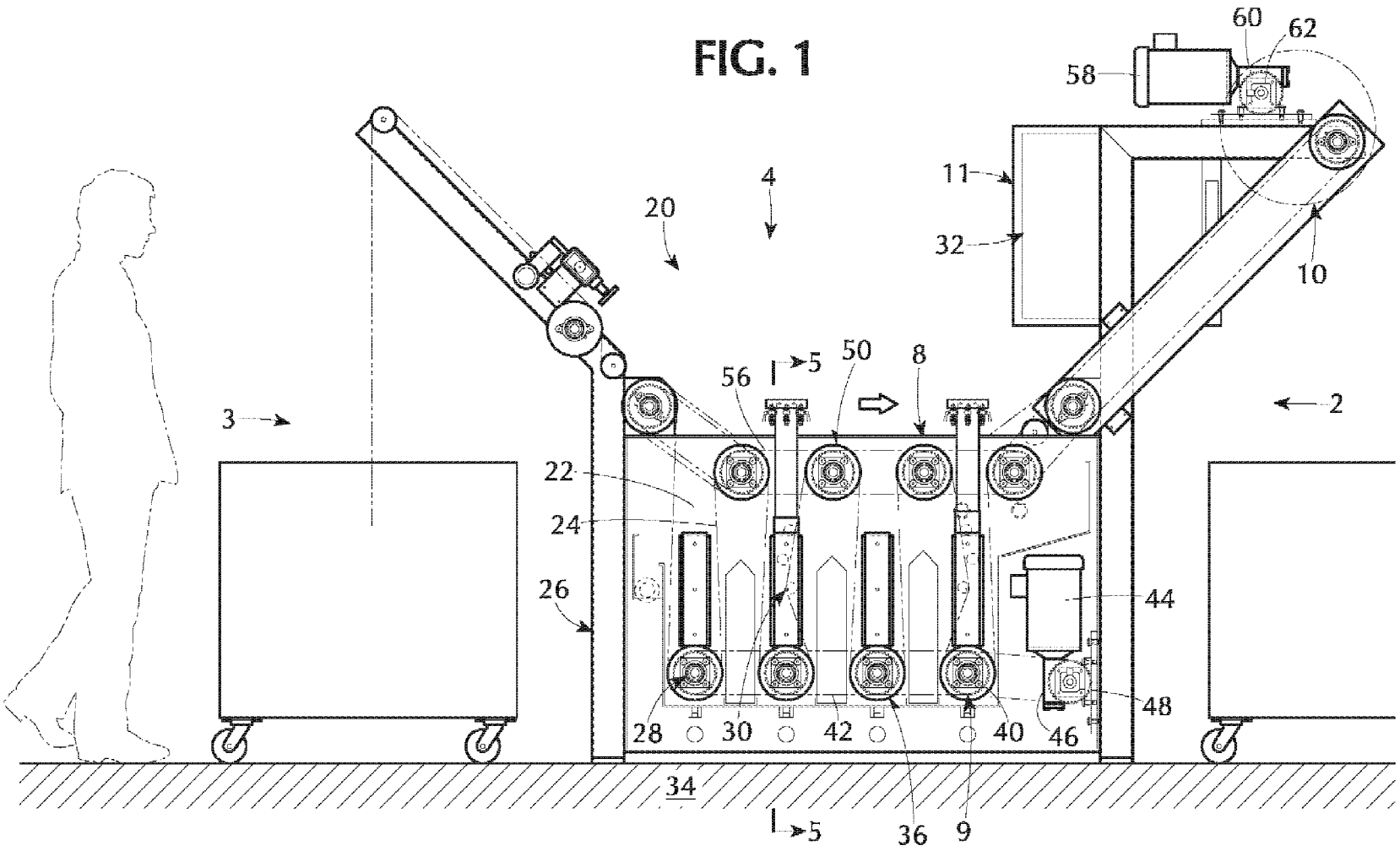

Referring now to the figures, in which like numerals indicate like parts, and particularly to FIG. 1, which is a diagrammatic side elevational view in partial section of the washer of the embodiments of the present invention utilizing a washing liquid and washing a continuous piece of tubular knitted fabric material having a total surface area and a tension and maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material, the washer of the embodiments of the present invention is shown generally at 20 for utilizing a washing liquid 22 for washing a continuous piece of tubular knitted fabric material 24 having a total surface area and a tension and for maximizing exposure of the total surface area of the continuous piece of tubular knitted fabric material 24 to the washing liquid 22 by ballooning the continuous piece of tubular knitted fabric material 24 while minimizing and keeping constant the tension of the continuous piece of tubular knitted fabric material 24 to thereby provide a more effective wash of the continuous piece of tubular knitted fabric material 24.

B. Overall Configuration of the Washer 20.

The overall configuration of the washer 20 can best be seen in FIGS. 1-4, which are, respectively, again, a diagrammatic side elevational view in partial section of the washer of the embodiments of the present invention utilizing a washing liquid and washing a continuous piece of tubular knitted fabric material having a total surface area and a tension and maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material, an enlarged diagrammatic rear end view taken generally in the direction of ARROW 2 in FIG. 1 of the washer of the embodiments of the present invention, an enlarged diagrammatic front end view taken generally in the direction of ARROW 3 in FIG. 1 of the washer of the embodiments of the present invention, and an enlarged diagrammatic top plan view taken generally in the direction of ARROW 4 in FIG. 1 of the washer of the embodiments of the present invention, and as such, will be discussed with reference thereto.

The washer 20 comprises a frame 26, a set of rollers 28, an air nozzle rack 30, and a controller 32. The frame 26 is for resting on a support surface 34. The set of rollers 28 are rotatably attached within the frame 26 and are for guiding the continuous piece of tubular knitted fabric material 24 through the washing liquid 22 for washing the continuous piece of tubular knitted fabric material 24. The air nozzle rack 30 is replaceably attached to within the frame 26 and is for blowing air onto the continuous piece of tubular knitted fabric material 24 to cause the ballooning of the continuous piece of tubular knitted fabric material 24 for maximizing the exposure of the total surface area of the continuous piece of tubular knitted fabric material 24 to the washing liquid 22. The controller 32 is operatively connected to the set of rollers 28 and is for minimizing and keeping constant the tension of the continuous piece of tubular knitted fabric material 24 as the continuous piece of tubular knitted fabric material 24 passes through the washing liquid 22 under an influence of the air nozzle rack 30 to thereby provide the more effective wash of the continuous piece of tubular knitted fabric material 24.

C. Specific Configuration of the Set of Rollers 28.

The specific configuration of the set of rollers 28 can best be seen in FIGS. 1-4 and 8-10, which are, respectively, again, a diagrammatic side elevational view in partial section of the washer of the embodiments of the present invention utilizing a washing liquid and washing a continuous piece of tubular knitted fabric material having a total surface area and a tension and maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material, again, an enlarged diagrammatic rear end view taken generally in the direction of ARROW 2 in FIG. 1 of the washer of the embodiments of the present invention, again, an enlarged diagrammatic front end view taken generally in the direction of ARROW 3 in FIG. 1 of the washer of the embodiments of the present invention, again, an enlarged diagrammatic top plan view taken generally in the direction of ARROW 4 in FIG. 1 of the washer of the embodiments of the present invention, an enlarged diagrammatic top plan view of the upper set of rollers of the washer of the embodiments of the present invention identified by ARROW 8 in FIG. 1, an enlarged diagrammatic top plan view of the lower set of rollers of the washer of the embodiments of the present invention identified by ARROW 9 in FIG. 1, and an enlarged diagrammatic top plan view of the area generally enclosed by the dotted curve identified by ARROW 10 in FIG. 1 of the upper power assembly of the upper set of rollers of the washer of the embodiments of the present invention, and as such, will be discussed with reference thereto.

The set of rollers 28 comprise a lower set of rollers 36. The lower set of rollers 36 of the set of rollers 28 are rotatably attached transversely to within the frame 26.

The lower set of rollers 36 of the set of rollers 28 are horizontally oriented, coplanar with each other, horizontally spaced-apart from each other, parallel to each other, and operatively connected to each other so as to rotate in unison.

Each lower roller 36 of the set of rollers 28 has a lower axle 38. The lower axle 38 of each lower roller 36 of the set of rollers 28 extends axially relative thereto and is rotatably attached to the frame 26 so as to allow the lower set of rollers 36 of the set of rollers 28 to be rotatably attached transversely to within the frame 26.

Each lower roller 36 of the set of rollers 28 further has a lower sprocket 40. The lower sprocket 40 of each lower roller 36 of the set of rollers 28 is attached to the lower axle 38 of an associated lower roller 36 of the set of rollers 28 so as to rotate therewith, and are in-line with each other.

The lower set of rollers 36 of the set of rollers 28 further has a lower sprocket chain 42. The lower sprocket chain 42 of the lower set of rollers 36 of the set of rollers 28 engages the lower sprocket 40 of each lower roller 36 of the set of rollers 28 so as to operatively connect each lower roller 36 of the set of rollers 28 to each other so as to rotate in unison.

The lower set of rollers 36 of the set of rollers 28 further has a lower motor 44. The lower motor 44 of the lower set of rollers 36 of the set of rollers 28 is affixed to the frame 26. A typical lower motor 44 of the lower set of rollers 36 of the set of rollers 28 is a BALDOR 2 HP motor 230/460 VAC. 3PH, but is not limited to that.

The lower set of rollers 36 of the set of rollers 28 further has a lower reducer 46. The lower reducer 46 of the lower set of rollers 36 of the set of rollers 28 is operatively connected to the lower motor 44 of the lower set of rollers 36 of the set of rollers 28 to rotate therewith. A typical lower reducer 46 of the lower set of rollers 36 of the set of rollers 28 is a WINSMITH reducer type 920 MCTS, but is not limited to that.

The lower set of rollers 36 of the set of rollers 28 further has a lower motor sprocket 48. The lower motor sprocket 48 of the lower set of rollers 36 of the set of rollers 28 is operatively connected to the lower reducer 46 of the lower set of rollers 36 of the set of rollers 28 to rotate therewith.

The lower sprocket chain of the lower set of rollers 36 of the set of rollers 28 further engages the lower motor sprocket 48 of the lower set of rollers 36 of the set of rollers 28 so as to allow the lower set of rollers 36 of the set of rollers 28 to rotate when the lower motor 44 of the lower set of rollers 36 of the set of rollers 28 is activated.

The set of rollers 28 further comprise an upper set of rollers 50. The upper set of rollers 50 of the set of rollers 28 are rotatably attached transversely to within the frame 26.

The upper set of rollers 50 of the set of rollers 28 are disposed above the lower set of rollers 36 of the set of rollers 28. Each upper roller 50 of the set of rollers 28 is disposed between an associated pair of the lower set of rollers 36 of the set of rollers 28 for allowing the continuous piece of tubular knitted fabric material 24 to alternatively engage around the lower set of rollers 36 of the set of rollers 28 and the upper set of rollers 50 of the set of rollers 28.

The upper set of rollers 50 of the set of rollers 28 are horizontally oriented, coplanar with each other, horizontally spaced-apart from each other, parallel to each other, and operatively connected to each other so as to rotate in unison.

Each upper roller 50 of the set of rollers 28 has an upper axle 52. The upper axle 52 of each upper roller 50 of the set of rollers 28 extends axially relative thereto and is rotatably attached to the frame 26 so as to allow the upper set of rollers 50 of the set of rollers 28 to be rotatably attached transversely to within the frame 26.

Each upper roller 50 of the set of rollers 28 further has an upper sprocket 54. The upper sprocket 54 of each upper roller 50 of the set of rollers 28 is attached to the upper axle 52 of an associated upper roller 50 of the set of rollers 28 so as to rotate therewith, and are in-line with each other.

The upper set of rollers 50 of the set of rollers 28 further has an upper sprocket chain 56. The upper sprocket chain 56 of the upper set of rollers 50 of the set of rollers 28 engages the upper sprocket 54 of each upper roller 50 of the set of rollers 28 so as to operatively connect each upper roller 50 of the set of rollers 28 to each other so as to rotate in unison.

The upper set of rollers 50 of the set of rollers 28 further has an upper motor 58. The upper motor 58 of the upper set of rollers 50 of the set of rollers 28 is affixed to the frame 26. A typical upper motor 58 of the upper set of rollers 50 of the set of rollers 28 is a BALDOR 2 HP motor 230/460 VAC. 3PH, but is not limited to that.

The upper set of rollers 50 of the set of rollers 28 further has an upper reducer 60. The upper reducer 60 of the upper set of rollers 50 of the set of rollers 28 is operatively connected to the upper motor 58 of the upper set of rollers 50 of the set of rollers 28 to rotate therewith. A typical upper reducer 60 of the upper set of rollers 50 of the set of rollers 28 is a WINSMITH reducer type 920 MCTS, but is not limited to that.

The upper set of rollers 50 of the set of rollers 28 further has an upper motor sprocket 62. The upper motor sprocket 62 of the upper set of rollers 50 of the set of rollers 28 is operatively connected to the upper reducer 60 of the upper set of rollers 50 of the set of rollers 28 to rotate therewith.

The upper sprocket chain 56 of the upper set of rollers 50 of the set of rollers 28 further engages the upper motor sprocket 62 of the upper set of rollers 50 of the set of rollers 28 so as to allow the upper set of rollers 50 of the set of rollers 28 to rotate when the upper motor 58 of the upper set of rollers 50 of the set of rollers 28 is activated.

D. Specific Configuration of the Air Nozzle Rack 30.

Figure 5:
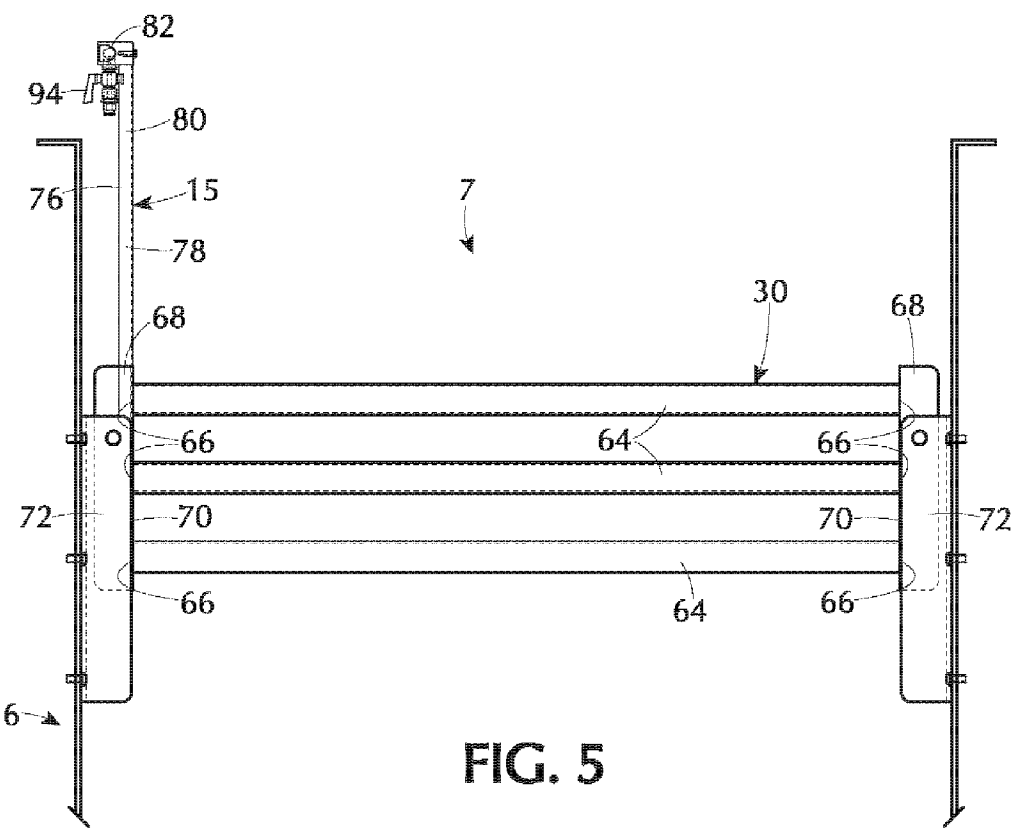
FIG. 5 is an enlarged diagrammatic front end view taken along LINE 5-5 in FIG. 1 of the air nozzle rack of the washer of the embodiments of the present invention.
Figure 7:
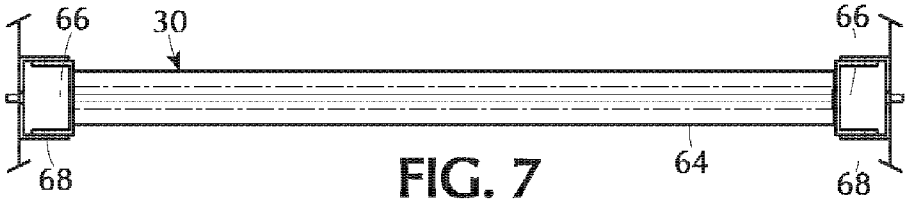
FIG. 7 is a diagrammatic top plan view taken generally in the direction of ARROW 7 in FIG. 5 of the air nozzle rack of the washer of the embodiments of the present invention.
Figure 10:
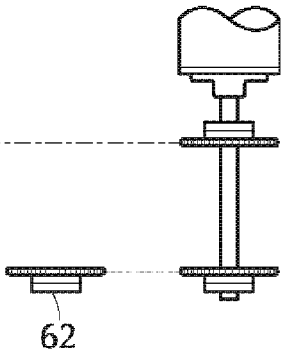
FIG. 10 is an enlarged diagrammatic top plan view of the area generally enclosed by the dotted curve identified by ARROW 10 in FIG. 1 of the upper power assembly of the upper set of rollers of the washer of the embodiments of the present invention.
Figure 8:
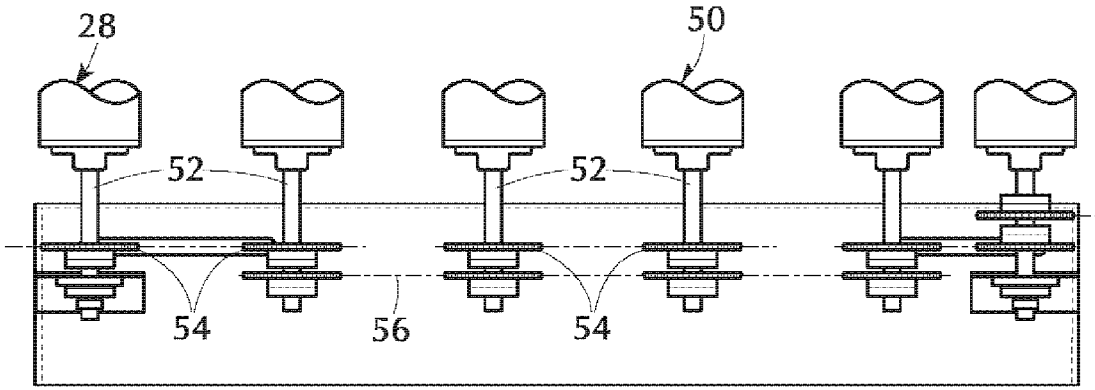
FIG. 8 is an enlarged diagrammatic top plan view of the upper set of rollers of the washer of the embodiments of the present invention identified by ARROW 8 in FIG. 1.
Figure 9:
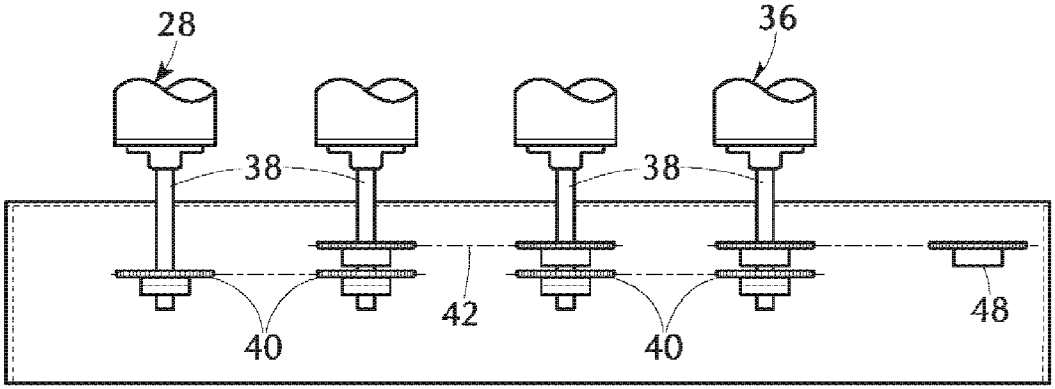
FIG. 9 is an enlarged diagrammatic top plan view of the lower set of rollers of the washer of the embodiments of the present invention identified by ARROW 9 in FIG. 1.
Figure 12:
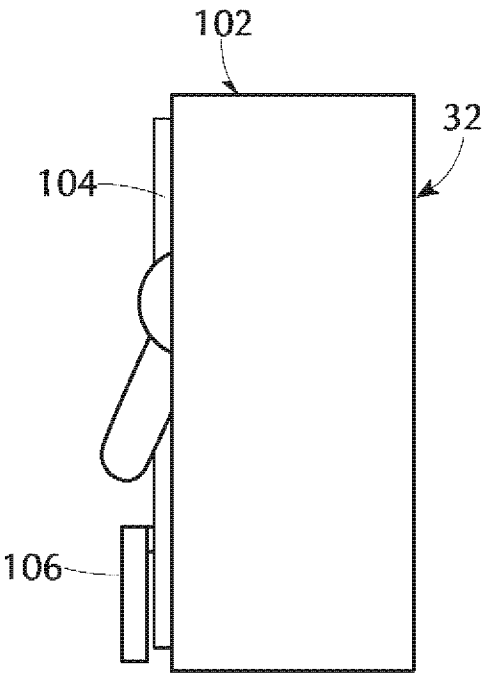
FIG. 12 is a diagrammatic end elevational view taken generally in the direction of ARROW 12 in FIG. 11 of the controller of the washer of the embodiments of the present invention.

The specific configuration of the air nozzle rack 30 can best be seen in FIGS. 5-7 and 15-18, which are, respectively, an enlarged diagrammatic front end view taken along LINE 5-5 in FIG. 1 of the air nozzle rack of the washer of the embodiments of the present invention, a diagrammatic side elevational view taken generally in the direction of ARROW 6 in FIG. 5 of the air nozzle rack of the washer of the embodiments of the present invention, a diagrammatic top plan view taken generally in the direction of ARROW 7 in FIG. 5 of the air nozzle rack of the washer of the embodiments of the present invention, an enlarged diagrammatic front elevational view of the air nozzle rack of the washer of the embodiments of the present invention identified by ARROW 15 in FIG. 5, a diagrammatic top plan view taken generally in the direction of ARROW 16 in FIG. 15 of the air nozzle rack of the washer of the embodiments of the present invention, a diagrammatic bottom plan view taken generally in the direction of ARROW 17 in FIG. 15 of the air nozzle rack of the washer of the embodiments of the present invention, and an enlarged diagrammatic front elevational view taken generally in the direction of ARROW 18 in FIG. 15 of the air box manifold of the air nozzle rack of the washer of the embodiments of the present invention, and as such, will be discussed with reference thereto.

The air nozzle rack 30 comprises hollow tubes 64. Each hollow tube 64 of the air nozzle rack 30 has a pair of ends 66. The pair of ends 66 of each hollow tube 64 of the air nozzle rack 30 are affixed perpendicularly to, and communicate with, a pair of brackets 68, respectively, which allow the air nozzle rack 30 to be replaceably attached to within the frame 26, between, and parallel to, a pair of adjacent upper rollers 50 of the set of rollers 28, and in-line with an associated lower roller 36 of the set of rollers 28.

Each bracket 68 of the air nozzle rack 30 is vertically oriented, and channel-shaped, and as such, has a web 70 and a pair of flanges 72. The pair of ends 66 of each hollow tube 64 of the air nozzle rack 30 are affixed perpendicularly to, and communicate with, the web 70 of the pair of brackets 68 of the air nozzle rack 30, respectively, with the pair of flanges 72 of the pair of brackets 68 of the air nozzle rack 30 extending outwardly therefrom so as to be replaceably affixed to the frame 26.

The hollow tubes 64 of the air nozzle rack 30 are horizontally oriented, coplanar with each other, vertically spaced-apart from each other, and parallel to each other.

The hollow tubes 64 of the air nozzle rack 30 contain orifices 74. The orifices 74 of the hollow tubes 64 of the air nozzle rack 30 are specifically oriented towards particular ones of the set of rollers 28 for blowing air onto the continuous piece of tubular knitted fabric material 24 to cause the ballooning of the continuous piece of tubular knitted fabric material 24 for maximizing the exposure of the total surface area of the continuous piece of tubular knitted fabric material 24 to the washing liquid 22.

The air nozzle rack 30 further comprises a manifold bracket 76. The manifold bracket 76 of the air nozzle rack 30 is vertically oriented and extends from within, and above, and communicates with, a particular one of the pair of brackets 68 of the air nozzle rack 30, and is maintained thereat, by screws, washers, lock washers, and nuts 77.

The manifold bracket 76 of the air nozzle rack 30 is channel-shaped, and as such, has a web 78 and a pair of flanges 80.

The web 78 of the manifold bracket 76 of the air nozzle rack 30 abuts against, from within, the web 70 of the particular one of the pair of brackets 68 of the air nozzle rack 30, and the pair of flanges 80 of the manifold bracket 76 of the air nozzle rack 30 abut against, from within, the pair of flanges 72 of the particular one of the pair of brackets 68 of the air nozzle rack 30 and extend outwardly therefrom.

The manifold bracket 76 of the air nozzle rack 30 has an uppermost end 81. The air nozzle rack 30 further comprises an air box manifold 82. The air box manifold 82 of the air nozzle rack 30 extends perpendicularly across the uppermost end 81 of the manifold bracket 76 of the air nozzle rack 30, and is maintained thereat, by a pair of screws and lock washers 84.

The air box manifold 82 of the air nozzle rack 30 has a lowermost surface 86 and a pair of ends 88.

The pair of ends 88 of the air box manifold 82 of the air nozzle rack 30 have communicating therewith an air fitting street elbow 90 for communicating with an air source 91, and a brass pipe plug 92, respectively.

The lowermost surface 86 of the air box manifold 82 of the air nozzle rack 30 has communicating therewith brass petcock valves 94.

The air nozzle rack 30 further comprises straight male air fittings 96. The straight male air fittings 96 of the air nozzle rack 30 depend communicatingly from the brass petcock valves 94 of the air box manifold 82 of the air nozzle rack 30, respectively.

The air nozzle rack 30 further comprises straight, street elbow, and male air fittings 98. The straight, street elbow, and male air fittings 98 of the air nozzle rack 30 are mounted in the particular one of the pair of brackets 68 of the air nozzle rack 30, and communicate with the hollow tubes 64 of the air nozzle rack 30.

The air nozzle rack 30 further comprises air hoses 100. The air hoses 100 of the air nozzle rack 30 extend from, and communicate with, the straight male air fittings 96 of the air nozzle rack 30 to, and communicate with, the combination straight/street elbow male air fittings 98 of the air nozzle rack 30, respectively.

E. Specific Configuration of the Controller 32.

Figure 2:
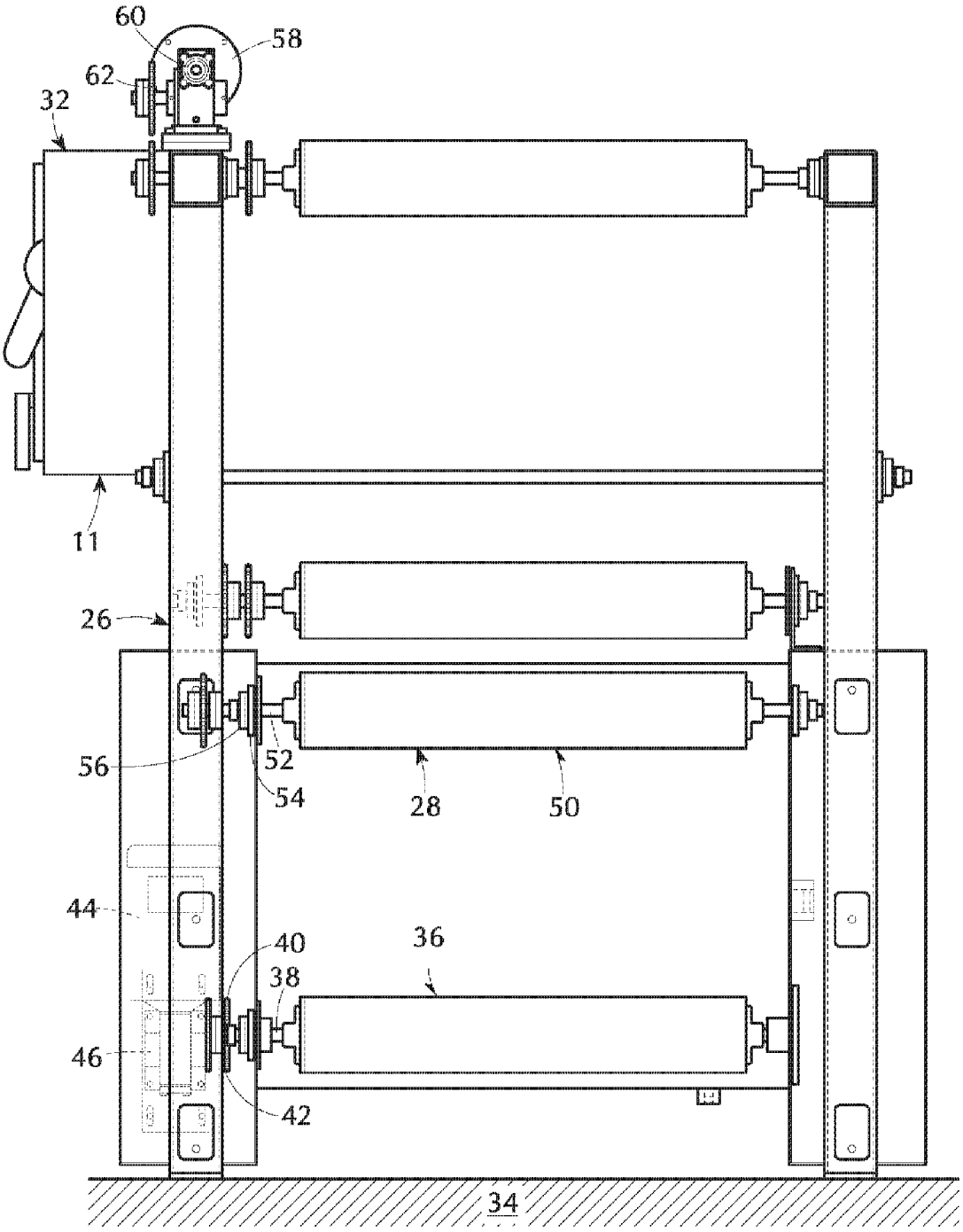
FIG. 2 is an enlarged diagrammatic rear end view taken generally in the direction of ARROW 2 in FIG. 1 of the washer of the embodiments of the present invention.
Figure 3:
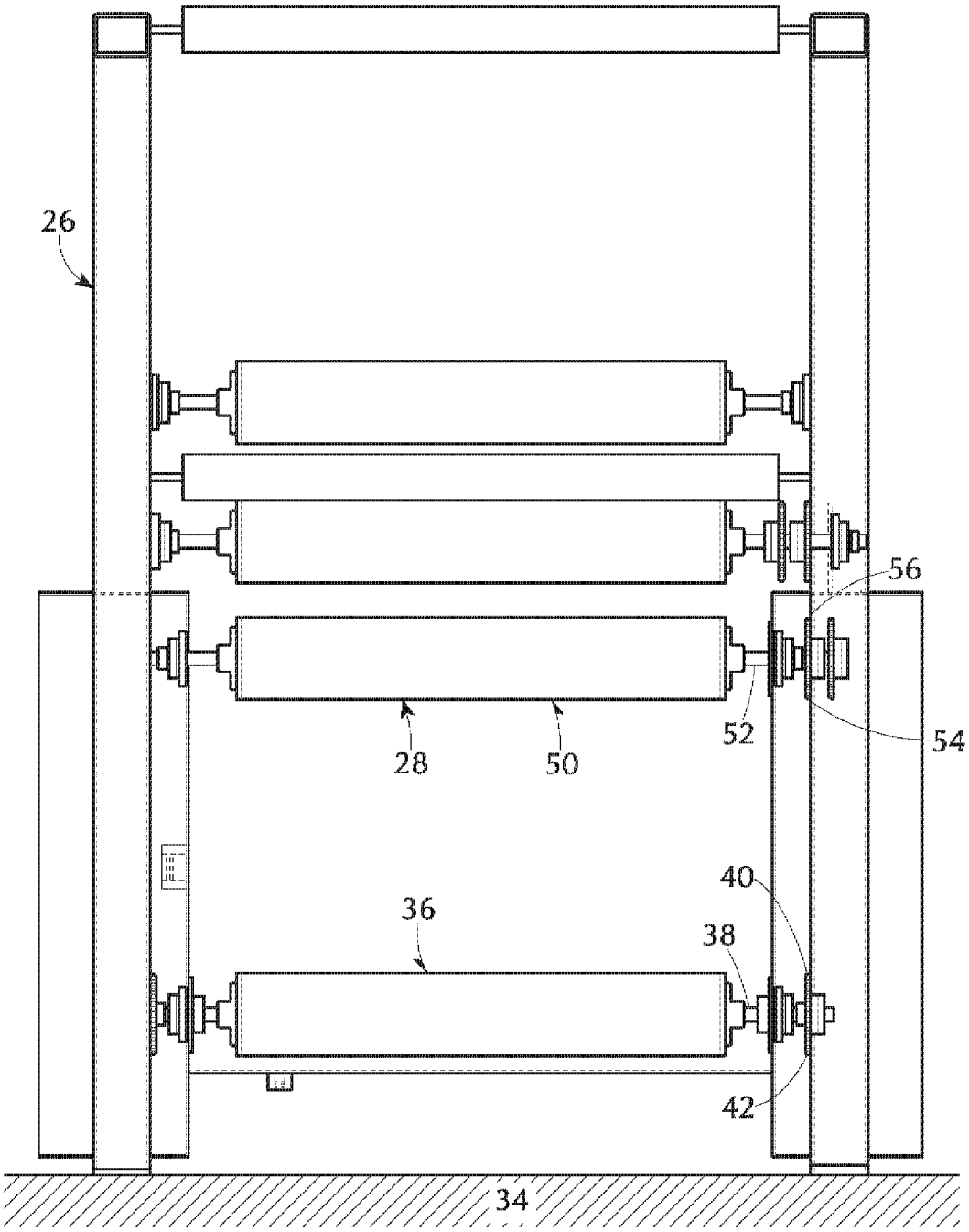
FIG. 3 is an enlarged diagrammatic front end view taken generally in the direction of ARROW 3 in FIG. 1 of the washer of the embodiments of the present invention.
Figure 4:
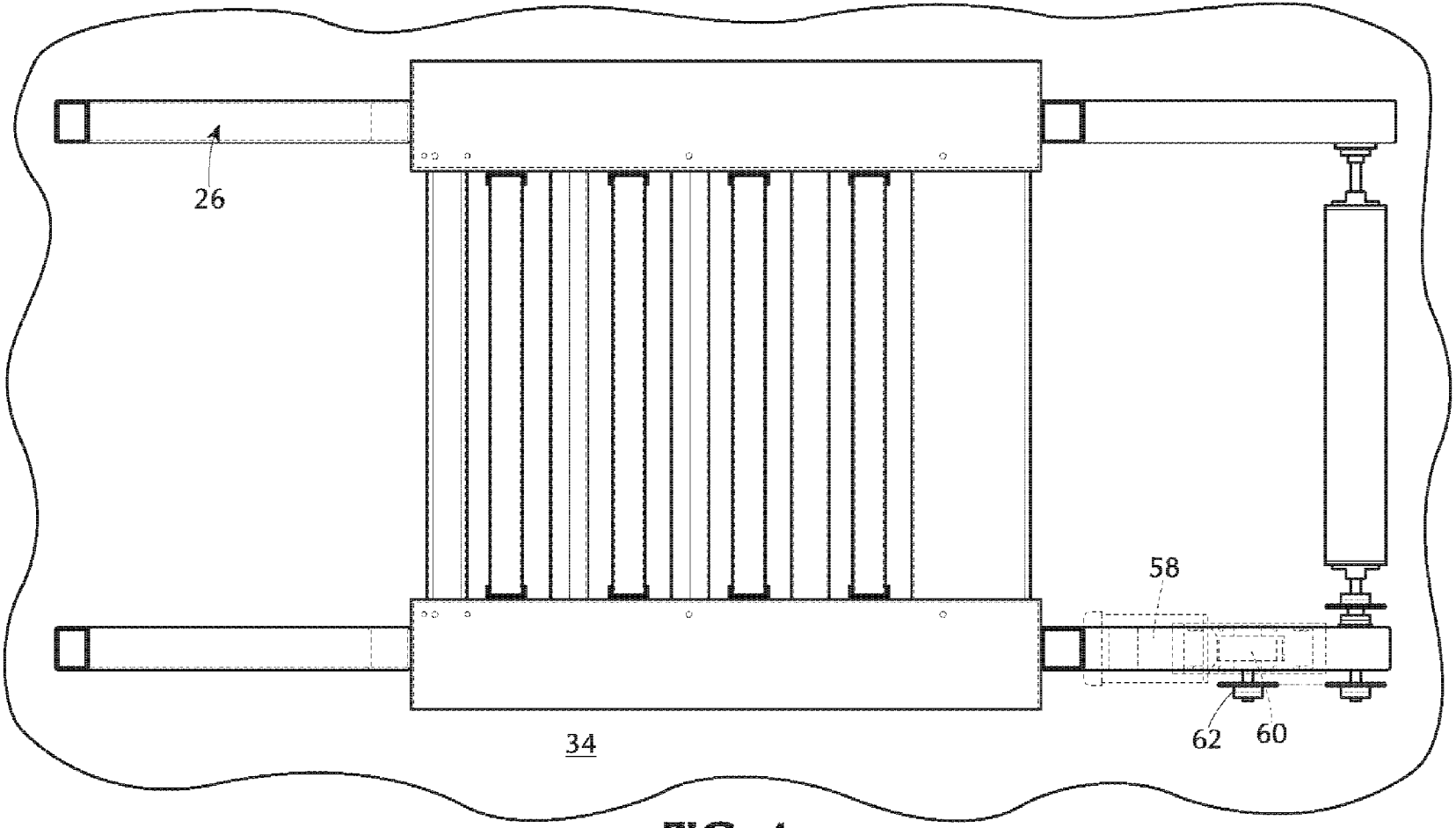
FIG. 4 is an enlarged diagrammatic top plan view taken generally in the direction of ARROW 4 in FIG. 1 of the washer of the embodiments of the present invention.
Figure 6:
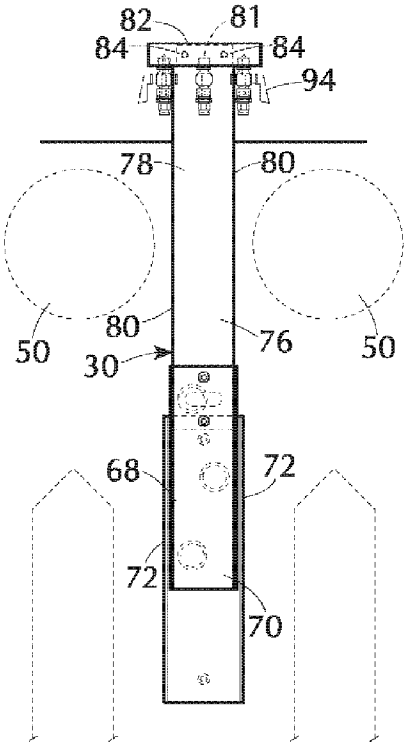
FIG. 6 is a diagrammatic side elevational view taken generally in the direction of ARROW 6 in FIG. 5 of the air nozzle rack of the washer of the embodiments of the present invention.
Figure 11:
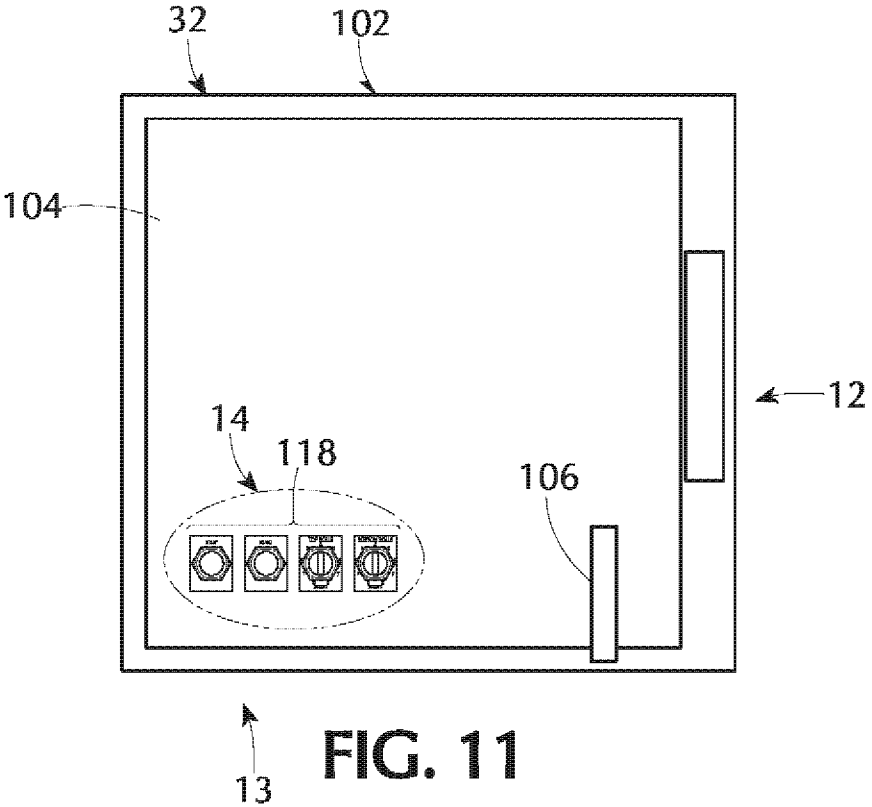
FIG. 11 is an enlarged diagrammatic side elevational view of the controller of the washer of the embodiments of the present invention identified by ARROW 11 in FIGS. 1 and 2.
Figure 13:
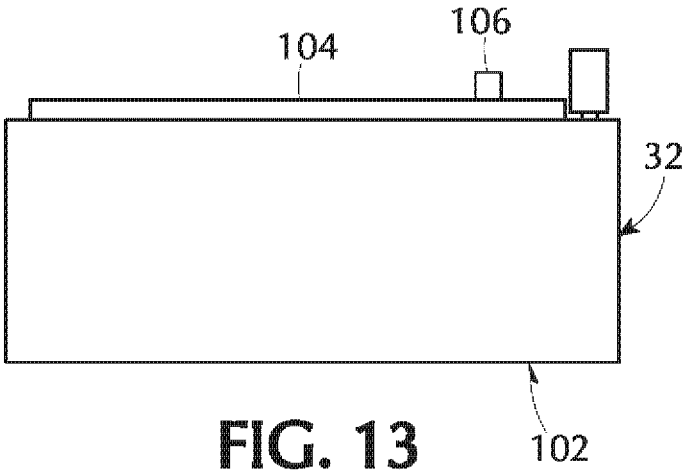
FIG. 13 is a diagrammatic bottom plan view taken generally in the direction of ARROW 13 in FIG. 11 of the controller of the washer of the embodiments of the present invention.
Figure 14:
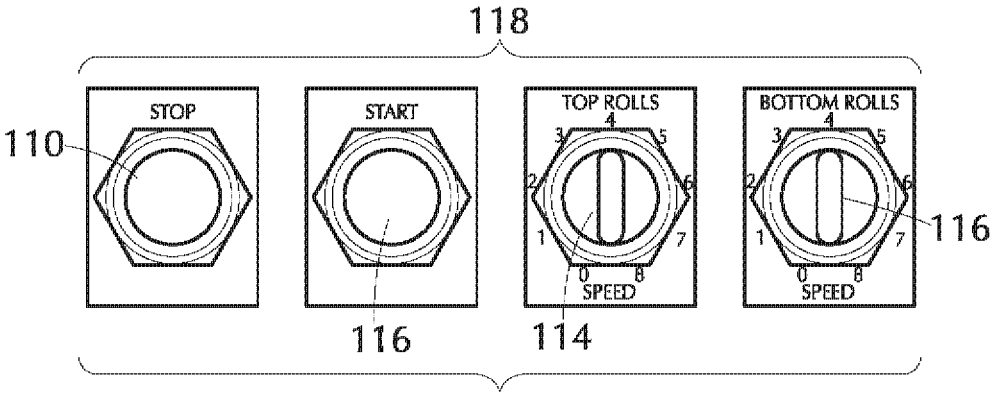
FIG. 14 is an enlarged diagrammatic side elevational view of the area generally enclosed by the dotted curve identified by ARROW 14 in FIG. 11 of the control panel of the controller of the washer of the embodiments of the present invention.

The specific configuration of the controller 32 can best be seen in FIGS. 11-14, which are, respectively, an enlarged diagrammatic side elevational view of the controller of the washer of the embodiments of the present invention identified by ARROW 11 in FIGS. 1 and 2, a diagrammatic end elevational view taken generally in the direction of ARROW 12 in FIG. 11 of the controller of the washer of the embodiments of the present invention, a diagrammatic bottom plan view taken generally in the direction of ARROW 13 in FIG. 11 of the controller of the washer of the embodiments of the present invention, and an enlarged diagrammatic side elevational view of the area generally enclosed by the dotted curve identified by ARROW 14 in FIG. 11 of the control panel of the controller of the washer of the embodiments of the present invention, and as such, will be discussed with reference thereto.

The controller 32 comprises a cabinet 102. The cabinet 102 of the controller 32 is affixed to the frame 26.

The cabinet 102 of the controller 32 has a door 104. The door 104 of the cabinet 102 of the controller 32 is hingedly attached thereto.

The cabinet 102 of the controller 32 further has a handle 106. The handle 106 of the cabinet 102 of the controller 32 is affixed to the door 104 of the cabinet 102 of the controller 32 so as to allow the door 104 of the cabinet 102 of the controller 32 to be easily opened and closed as needed.

The cabinet 102 of the controller 32 further has a control panel 108. The control panel 108 of the cabinet 102 of the controller 32 is disposed on the door 104 of the cabinet 102 of the controller 32.

The control panel 108 of the cabinet 102 of the controller 32 comprises a stop push button 110, a start push button 112, an upper roller speed rotary control 114, and a lower roller speed rotary control 116.

The upper motor 58 of the upper set of rollers 50 of the set of rollers 28 has a rotational speed, and the upper set of rollers 50 of the set of rollers 28 have a rotational speed. The upper roller speed rotary control 114 of the control panel 108 of the cabinet 102 of the controller 32 is operatively connected to the upper motor 58 of the upper set of rollers 50 of the set of rollers 28 to control the rotational speed of the upper motor 58 of the upper set of rollers 50 of the set of rollers 28 and thereby control the rotational speed of the upper set of rollers 50 of the set of rollers 28.

The lower motor 44 of the lower set of rollers 36 of the set of rollers 28 has a rotational speed, and the lower set of rollers 36 of the set of rollers 28 have a rotational speed. The lower roller speed rotary control 116 of the control panel 108 of the cabinet 102 of the controller 32 is operatively connected to the lower motor 44 of the lower set of rollers 36 of the set of rollers 28 to control the rotational speed of the lower motor 44 of the lower set of rollers 36 of the set of rollers 28 and thereby control the rotational speed of the lower set of rollers 36 of the set of rollers 28.

F. Operation of the Washer 20.

The continuous piece of tubular knitted fabric material 24 is threaded alternatively over the upper set of rollers 50 of the set of rollers 28 and then under the lower set of rollers 36 of the set of rollers 28.

Adjusting the rotational speed of the upper set of rollers 50 of the set of rollers 28 and the rotational speed of the lower set of rollers 36 of the set of rollers 28 independently of each other controls the tension of the continuous piece of tubular knitted fabric material 24 and the ballooning of the continuous piece of tubular knitted fabric material 24 for maximizing the exposure of the total surface area of the continuous piece of tubular knitted fabric material 24 to the washing liquid 22.

The rotational speed of the lower set of rollers 36 of the set of rollers 28 is set to run slightly faster than the rotational speed of the upper set of rollers 50 of the set of rollers 28. This in turn causes the continuous piece of tubular knitted fabric material 24 to tighten creating the tension in the continuous piece of tubular knitted fabric material 24 as the continuous piece of tubular knitted fabric material 24 starts to slip on the lower set of rollers 36 of the set of rollers 28.

By stopping or slowing down the rotational speed of the lower set of rollers 36 of the set of rollers 28 for a moment loosens the tension of the continuous piece of tubular knitted fabric material 24 and creates a loop of the continuous piece of tubular knitted fabric material 24 around the lower set of rollers 36 of the set of rollers 28. This causes the continuous piece of tubular knitted fabric material 24 to slip on the lower set of rollers 36 of the set of rollers 28.

By starting the lower set of rollers 36 of the set of rollers 28 again shortens the loop of the continuous piece of tubular knitted fabric material 24 and drives the continuous piece of tubular knitted fabric material 24.

By adjusting the rotational speed of the lower set of rollers 36 of the set of rollers 28 and the rotational speed of the upper set of rollers 50 of the set of rollers 28 in combination with adjusting time from stop to start results in a desired average tension of the continuous piece of tubular knitted fabric material 24 automatically.

G. Impressions.

It will be understood that each of the elements described above, or two or more together, may also find a useful application in other types of constructions differing from the types described above.

While the embodiments of the present invention have been illustrated and described as embodied in a washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A washer for utilizing a washing liquid for washing a continuous piece of tubular knitted fabric material having a total surface area and a tension and for maximizing exposure of the total surface area of the continuous piece of tubular knitted fabric material to the washing liquid by ballooning the continuous piece of tubular knitted fabric material while minimizing and keeping constant the tension of the continuous piece of tubular knitted fabric material to thereby provide a more effective wash of the continuous piece of tubular knitted fabric material, comprising:

a) a frame;

b) a set of rollers;

c) an air nozzle rack; and d) a controller;

wherein said frame is for resting on a support surface;

wherein said set of rollers are rotatably attached within the frame;

wherein said set of rollers are for guiding the continuous piece of tubular knitted fabric material through the washing liquid for washing the continuous piece of tubular knitted fabric material;

wherein said air nozzle rack is replaceably attached to within said frame;

wherein said air nozzle rack is for blowing air onto the continuous piece of tubular knitted fabric material to cause the ballooning of the continuous piece of tubular knitted fabric material for maximizing the exposure of the total surface area of the continuous piece of tubular knitted fabric material to the washing liquid;

wherein said controller is operatively connected to said set of rollers to minimize and keep constant the tension of the continuous piece of tubular knitted fabric material as the continuous piece of tubular knitted fabric material passes through the washing liquid under an influence of said air nozzle rack to thereby provide the more effective wash of the continuous piece of tubular knitted fabric material.

2. The washer of claim 1, wherein said set of rollers comprise a lower set of rollers; and wherein said lower set of rollers of said set of rollers are rotatably attached transversely to within said frame.

3. The washer of claim 2, wherein each lower roller of said set of rollers has a lower axle;

wherein said lower axle of each lower roller of said set of rollers extends axially relative thereto; and wherein said lower axle of each lower roller of said set of rollers is rotatably attached to said frame so as to allow said lower set of rollers of said set of rollers to be rotatably attached transversely to within said frame.

4. The washer of claim 2, wherein said lower set of rollers of said set of rollers are horizontally oriented;

wherein said lower set of rollers of said set of rollers are coplanar with each other;

wherein said lower set of rollers of said set of rollers are horizontally spaced-apart from each other;

wherein said lower set of rollers of said set of rollers are parallel to each other; and wherein said lower set of rollers of said set of rollers are operatively connected to each other so as to rotate in unison.

5. The washer of claim 3, wherein each lower roller of said set of rollers has a lower sprocket;

wherein said lower sprocket of each lower roller of said set of rollers is attached to said lower axle of an associated lower roller of said set of rollers so as to rotate therewith; and wherein said lower sprocket of each lower roller of said set of rollers are in-line with each other.

6. The washer of claim 5, wherein said lower set of rollers of said set of rollers has a lower sprocket chain; and wherein said lower sprocket chain of said lower set of rollers of said set of rollers engages said lower sprocket of each lower roller of said set of rollers so as to operatively connect each lower roller of said set of rollers to each other so as to rotate in unison.

7. The washer of claim 6, wherein said lower set of rollers of said set of rollers has a lower motor; and wherein said lower motor of said lower set of rollers of said set of rollers is affixed to said frame.

8. The washer of claim 7, wherein said set of rollers comprise an upper set of rollers; and wherein said upper set of rollers of said set of rollers are rotatably attached transversely to within said frame.

9. The washer of claim 8, wherein said upper set of rollers of said set of rollers are disposed above said lower set of rollers of said set of rollers; and wherein each upper roller of said set of rollers is disposed between an associated pair of said lower set of rollers of said set of rollers for allowing said continuous piece of tubular knitted fabric material to alternatively engage around said lower set of rollers of said set of rollers and said upper set of rollers of said set of rollers.

10. The washer of claim 8, wherein said upper set of rollers of said set of rollers are horizontally oriented;

wherein said upper set of rollers of said set of rollers are coplanar with each other;

wherein said upper set of rollers of said set of rollers are horizontally spaced-apart from each other;

wherein said upper set of rollers of said set of rollers are parallel to each other; and wherein said upper set of rollers of said set of rollers are operatively connected to each other so as to rotate in unison.

11. The washer of claim 8, wherein each upper roller of said set of rollers has an upper axle;

wherein said upper axle of each upper roller of said set of rollers extends axially relative thereto; and wherein said upper axle of each upper roller of said set of rollers is rotatably attached to said frame so as to allow said upper set of rollers of said set of rollers to be rotatably attached transversely to within said frame.

12. The washer of claim 11, wherein each upper roller of said set of rollers has an upper sprocket;

wherein said upper sprocket of each upper roller of said set of rollers is attached to said upper axle of an associated upper roller of said set of rollers so as to rotate therewith; and wherein said upper sprocket of each upper roller of said set of rollers are in-line with each other.

13. The washer of claim 12, wherein said upper set of rollers of said set of rollers has an upper sprocket chain; and wherein said upper sprocket chain of said upper set of rollers of said set of rollers engages said upper sprocket of each upper roller of said set of rollers so as to operatively connect each upper roller of said set of rollers to each other so as to rotate in unison.

14. The washer of claim 13, wherein said upper set of rollers of said set of rollers has an upper motor; and wherein said upper motor of said upper set of rollers of said set of rollers is affixed to said frame.

15. The washer of claim 14, wherein said controller comprises a cabinet; and wherein said cabinet of said controller is affixed to said frame.

16. The washer of claim 15, wherein said cabinet of said controller has a door; and wherein said door of said cabinet of said controller is hingedly attached thereto.

17. The washer of claim 16, wherein said cabinet of said controller has a handle; and wherein said handle of said cabinet of said controller is affixed to said door of said cabinet of said controller so as to allow said door of said cabinet of said controller to be easily opened and closed as needed.

18. The washer of claim 16, wherein said cabinet of said controller has a control panel; and wherein said control panel of said cabinet of said controller is disposed on said door of said cabinet of said controller.

19. The washer of claim 18, wherein said control panel of said cabinet of said controller comprises:

a) a stop push button;

b) a start push button;

c) an upper roller speed rotary control; and d) a lower roller speed rotary control.

20. The washer of claim 19, wherein said upper motor of said upper set of rollers of said set of rollers has a rotational speed;

wherein said upper set of rollers of said set of rollers have a rotational speed; and wherein said upper roller speed rotary control of said control panel of said cabinet of said controller is operatively connected to said upper motor of said upper set of rollers of said set of rollers to control said rotational speed of said upper motor of said upper set of rollers of said set of rollers and thereby said rotational speed of said upper set of rollers of said set of rollers.

21. The washer of claim 20, wherein said lower motor of said lower set of rollers of said set of rollers has a rotational speed;

wherein said lower set of rollers of said set of rollers have a rotational speed; and wherein said lower roller speed rotary control of said control panel of said cabinet of said controller is operatively connected to said lower motor of said lower set of rollers of said set of rollers to control said rotational speed of said lower motor of said lower set of rollers of said set of rollers and thereby said rotational speed of said lower set of rollers of said set of rollers.

22. The washer of claim 21, wherein adjusting said rotational speed of said upper set of rollers of said set of rollers and said rotational speed of said lower set of rollers of said set of rollers independently of each other controls the tension of the continuous piece of tubular knitted fabric material and the ballooning of the continuous piece of tubular knitted fabric material for maximizing the exposure of the total surface area of the continuous piece of tubular knitted fabric material to the washing liquid.

23. The washer of claim 21, wherein said rotational speed of said lower set of rollers of said set of rollers is set to run slightly faster than said rotational speed of said upper set of rollers of said set of rollers, which in turn causes the continuous piece of tubular knitted fabric material to tighten creating the tension in the continuous piece of tubular knitted fabric material as the continuous piece of tubular knitted fabric material starts to slip on said lower set of rollers of said set of rollers, and by stopping or slowing down said rotational speed of said lower set of rollers of said set of rollers for a moment loosens the tension of the continuous piece of tubular knitted fabric material and creates a loop of the continuous piece of tubular knitted fabric material around said lower set of rollers of said set of rollers causing the continuous piece of tubular knitted fabric material to slip on said lower set of rollers of said set of rollers, and by starting said lower set of rollers of said set of rollers again shortens the loop of the continuous piece of tubular knitted fabric material and drives the continuous piece of tubular knitted fabric material, and by adjusting said rotational speed of said lower set of rollers of said set of rollers and said rotational speed of said upper set of rollers of said set of rollers in combination with time from stop to start results in a desired average tension of the continuous piece of tubular knitted fabric material automatically.

24. The washer of claim 14, wherein said upper set of rollers of said set of rollers has an upper reducer; and wherein said upper reducer of said upper set of rollers of said set of rollers is operatively connected to said upper motor of said upper set of rollers of said set of rollers to rotate therewith.

25. The washer of claim 24, wherein said upper set of rollers of said set of rollers has an upper motor sprocket; and wherein said upper motor sprocket of said upper set of rollers of said set of rollers is operatively connected to said upper reducer of said upper set of rollers of said set of rollers to rotate therewith.

26. The washer of claim 25, wherein said upper sprocket chain of said upper set of rollers of said set of rollers further engages said upper motor sprocket of said upper set of rollers of said set of rollers so as to allow said upper set of rollers of said set of rollers to rotate when said upper motor of said upper set of rollers of said set of rollers is activated.

27. The washer of claim 8, wherein said air nozzle rack comprises hollow tubes;

wherein each hollow tube of said air nozzle rack has a pair of ends;

wherein said pair of ends of each hollow tube of said air nozzle rack are affixed perpendicularly to, and communicate with, a pair of brackets, respectively, which allow said air nozzle rack to be replaceably attached to within said frame, between, and parallel to, a pair of adjacent upper rollers of said set of rollers, and in-line with an associated lower roller of said set of rollers.

28. The washer of claim 27, wherein each bracket of said air nozzle rack is vertically oriented;

wherein each bracket of said air nozzle rack is channel-shaped, and as such, has:

a) a web; and b) a pair of flanges; and wherein said pair of ends of each hollow tube of said air nozzle rack are affixed perpendicularly to, and communicate with, said web of said pair of brackets of said air nozzle rack, respectively, with said pair of flanges of said pair of brackets of said air nozzle rack extending outwardly therefrom so as to be replaceably affixed to said frame.

29. The washer of claim 28, wherein said air nozzle rack comprises a manifold bracket;

wherein said manifold bracket of said air nozzle rack is vertically oriented;

wherein said manifold bracket of said air nozzle rack extends from within a particular one of said pair of brackets of said air nozzle rack;

wherein said manifold bracket of said air nozzle rack extends above said particular one of said pair of brackets of said air nozzle rack, and is maintained thereat, by combination screws/washers/lock washers/nuts; and wherein said manifold bracket of said air nozzle rack communicates with said particular one of said pair of brackets of said air nozzle rack.

30. The washer of claim 29, wherein said manifold bracket of said air nozzle rack is channel-shaped, and as such, has:

a) a web; and b) a pair of flanges;

wherein said web of said manifold bracket of said air nozzle rack abuts against from within said web of said particular one of said pair of brackets of said air nozzle rack; and wherein said pair of flanges of said manifold bracket of said air nozzle rack abut against from within said pair of flanges of said particular one of said pair of brackets of said air nozzle rack extending outwardly therefrom.

31. The washer of claim 29, wherein said manifold bracket of said air nozzle rack has an uppermost end;

wherein said air nozzle rack comprises an air box manifold; and wherein said air box manifold of said air nozzle rack extends perpendicularly across said uppermost end of said manifold bracket of said air nozzle rack, and is maintained thereat, by a pair of screws and lock washers.

32. The washer of claim 31, wherein said air box manifold of said air nozzle rack has a pair of ends; and wherein said pair of ends of said air box manifold of said air nozzle rack have communicating therewith an air fitting street elbow for communicating with an air source, and a brass pipe plug, respectively.

33. The washer of claim 31, wherein said air box manifold of said air nozzle rack has a lowermost surface; and wherein said lowermost surface of said air box manifold of said air nozzle rack has communicating therewith brass petcock valves.

34. The washer of claim 33, wherein said air nozzle rack comprises straight and male air fittings; and wherein said straight and male air fittings of said air nozzle rack depend communicatingly from said brass petcock valves of said air box manifold of said air nozzle rack, respectively.

35. The washer of claim 34, wherein said air nozzle rack comprises straight, street elbow, and male air fittings; and wherein said straight, street elbow, and male air fittings of said air nozzle rack are mounted in said particular one of said pair of brackets of said air nozzle rack, and communicate with said hollow tubes of said air nozzle rack.

36. The washer of claim 35, wherein said air nozzle rack comprises air hoses; and wherein said air hoses of said air nozzle rack extend from, and communicate with, said straight and male air fittings of said air nozzle rack to, and communicate with, said straight, street elbow, and male air fittings of said air nozzle rack, respectively.

37. The washer of claim 27, wherein said hollow tubes of said air nozzle rack are horizontally oriented;

wherein said hollow tubes of said air nozzle rack are coplanar with each other;

wherein said hollow tubes of said air nozzle rack are vertically spaced-apart from each other; and wherein said hollow tubes of said air nozzle rack are parallel to each other.

38. The washer of claim 27, wherein said hollow tubes of said air nozzle rack contain orifices;

wherein said orifices of said hollow tubes of said air nozzle rack are specifically oriented towards particular ones of said set of rollers; and wherein said orifices of said hollow tubes of said air nozzle rack are for blowing air onto the continuous piece of tubular knitted fabric material to cause the ballooning of the continuous piece of tubular knitted fabric material for maximizing the exposure of the total surface area of the continuous piece of tubular knitted fabric material to the washing liquid.

39. The washer of claim 8, wherein said continuous piece of tubular knitted fabric material is threaded alternatively over said upper set of rollers of said set of rollers and then under said lower set of rollers of said set of rollers.

40. The washer of claim 7, wherein said lower set of rollers of said set of rollers has a lower reducer; and wherein said lower reducer of said lower set of rollers of said set of rollers is operatively connected to said lower motor of said lower set of rollers of said set of rollers to rotate therewith.

41. The washer of claim 40, wherein said lower set of rollers of said set of rollers has a lower motor sprocket; and wherein said lower motor sprocket of said lower set of rollers of said set of rollers is operatively connected to said lower reducer of said lower set of rollers of said set of rollers to rotate therewith.

42. The washer of claim 41, wherein said lower sprocket chain of said lower set of rollers of said set of rollers engages said lower motor sprocket of said lower set of rollers of said set of rollers so as to allow said lower set of rollers of said set of rollers to rotate when said lower motor of said lower set of rollers of said set of rollers is activated.

* * * * *